United States Patent [19]

Watanabe et al.

[11] 4,232,690

[45] Nov. 11, 1980

[54] COIN KIND AND NUMBER SETTING AND ADJUSTING DEVICE FOR COIN PACKAGING MACHINE

[75] Inventors: Kenkichi Watanabe; Katusuke Furuya, both of Tokyo, Japan

[73] Assignee: Laurel Bank Machine Co., Ltd., Tokyo, Japan

[21] Appl. No.: 936,787

[22] Filed: Aug. 25, 1978

[30] Foreign Application Priority Data

Aug. 31, 1977 [JP] Japan ..... 52-105360

[51] Int. Cl.[3] ..... G07D 09/04

[52] U.S. Cl. ..... 133/8 R; 53/212; 133/1 A; 133/8 A

[58] Field of Search ..... 133/1 R, 1 A, 8 R, 8 A, 133/8 C; 53/212, 501, 77

[56] References Cited

U.S. PATENT DOCUMENTS

| | | | |
|---|---|---|---|
| 2,841,934 | 7/1958 | Schoenewolf | 53/501 |
| 3,350,835 | 11/1967 | Becker | 53/212 X |
| 3,938,303 | 2/1976 | Ushio et al. | 53/212 |

FOREIGN PATENT DOCUMENTS 38-17150 9/1963 Japan .

*Primary Examiner*—Robert J. Spar
*Assistant Examiner*—Edward M. Wacyra
*Attorney, Agent, or Firm*—Fleit & Jacobson

[57] ABSTRACT

Herein disclosed is a coin kind and number setting and adjusting device for use with a coin packaging machine including a dial for setting the kind of coins and a second dial for setting the number of the coins, which is suitable for the set kind. The device comprises a gate for detecting the coincidence between the signals indicative of the kind of the coins, which is set by the first-named dial, and the signals indicative of the number of the coins, which is set by the second-named dial, so that it may operate the coin packaging machine only when preset conditions are satisfied. The coin packaging machine can be left inoperative if the setting of the coin number is so bad as to fail to coincide with that which is set for the set kind of the coins. Moreover, the number of the coins can be automatically set for the set coin kind.

1 Claim, 12 Drawing Figures

COIN KIND AND NUMBER SETTING AND ADJUSTING DEVICE FOR COIN PACKAGING MACHINE

BACKGROUND OF THE INVENTION

1. Field of the Invention

The present invention relates to a coin packaging machine, and more particularly to a coin kind and number setting and adjusting device for use with the coin packaging machine.

2. Description of the Prior Art

As is well known in the relevant art, in a coin packaging machine, the kind of coins is set by a coin kind setting dial, and the number of the coins is set for the set kind by a coin number setting dial. In a country, e.g., where the number of coins to be packaged is different for the various kinds of the coins, the operator of the coin packaging machine has to set the kind with the use of a coin kind setting dial and then to operate a coin number setting dial so as to set the number in accordance with the preset kind. The operator may often forget those troublesome operations or set a mistaken number of the coins so that the piled height of the coins is not suitable for the width size of the packaging paper, thus leading to failure in satisfactory package. Moreover, the coins may be scattered and lost, or the scattered coins are jammed at the moving parts of the coin packaging machine so that this machine is damaged. If, on the other hand, the change of the kind of the coins takes place frequently, the mental loads upon the operator become heavy.

SUMMARY OF THE INVENTION

It is, therefore, an object of the present invention to provide such a coin kind and number setting and adjusting device for use with a coin packaging machine as is free from the drawbacks concomitant with the prior art.

Another object of the present invention is to provide a coin kind and number setting and adjusting device, by which the coin packaging machine is left inoperative if the setting of the coin number is so bad as to fail to coincide with that which is set for the set kind of the coins.

A further object of the present invention is to provide a coin kind and number setting and adjusting device, by which the number of the coins can be automatically set for the set coin kind.

According to a major feature of the present invention, there is provided a coin kind and number setting and adjusting device for use with a coin packaging machine including a dial for setting the kind of coins and a second dial for setting number of the coins, which is suitable for the set kind, said device comprising a gate circuit for detecting the coincidence between the signals indicative of the kind of the coins, which is set by the first-named dial, and the signals indicative of the number of the coins, which is set by the second-named dial, so that it may operate the coin packaging machine only when preset conditions are satisfied.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENTS

The present invention will be described hereinafter in connection with its embodiments with reference to the accompanying drawings.

Figure 1:
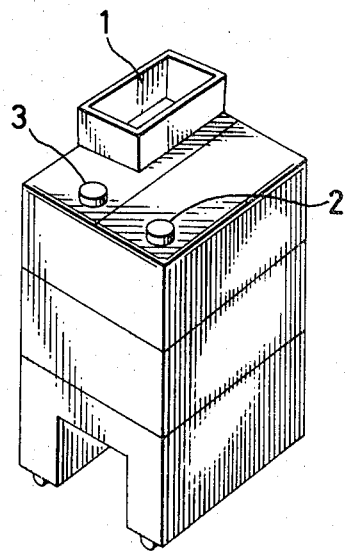
FIG. 1 is a diagrammatical perspective view showing a coin packing machine, with which a coin kind and number setting and adjusting device according to the present invention is used.

Reference is first made to FIG. 1 showing in perspective view a coin packaging machine, in which a device for setting and adjusting the kind and number of coins according to the present invention is used. Reference numeral 1 indicates a slot for coin insertion, numeral 2 a coin kind setting dial, and numeral 3 a coin number setting dial.

Figure 2:
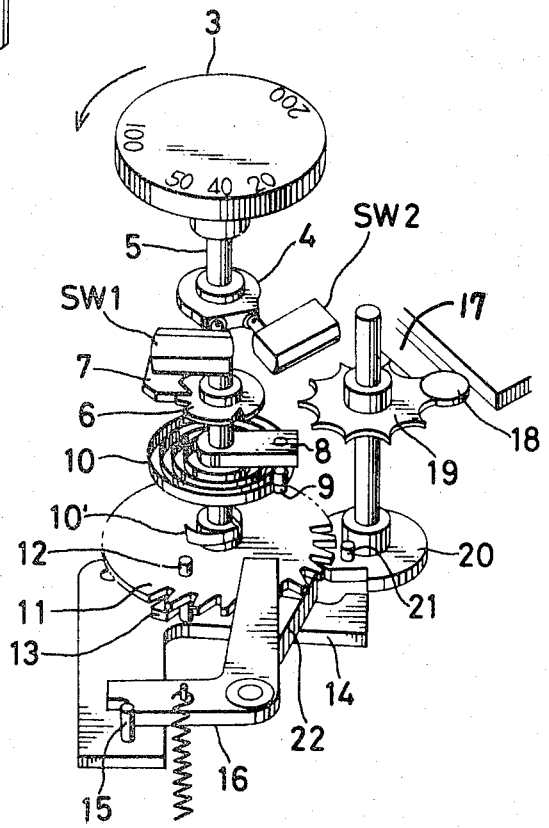
FIG. 2 is an exploded perspective view showing major parts of a counting mechanism.

FIG. 2 is an exploded perspective view showing those parts of a counting mechanism, which are made coactive with the number setting dial 3. There is located below the dial 3 a coin number setting cam 4 which is fixed coaxially to the dial 3 such that it is brought, when turned, into contact to operate two setting switches SW1 and SW2. A positioning cam 6 is fixed to a dial shaft 5 such that it is engageable with a normally biased positioning pawl 7. A spring holding lever 8, which is fixed to the dial shaft 5, is constructed to have its pin 9 retaining one end of a spiral spring 10, the other end 10' of which is fixed to the hub of a Geneva gear 11. This gear 11 has its resetting pin 12 engaging with a count start positioning lever 13 of the dial shaft 5. A pin 15 for holding a stopper under a counting condition is constructed to engage with a resetting lever 16.

Coins 18 passing through their selecting path 17 are brought into engagement with a star-wheel 19. As a result, a stop wheel 20, which is mounted to the common shaft of the star-wheel 19, is constructed to have its counting pin 21 engaging with the teeth of the Geneva gear 11 so as to take up the units one by one. A detent 22 is used to prevent the Geneva gear 11 having its units taken up from opposite rotation.

Figure 4:
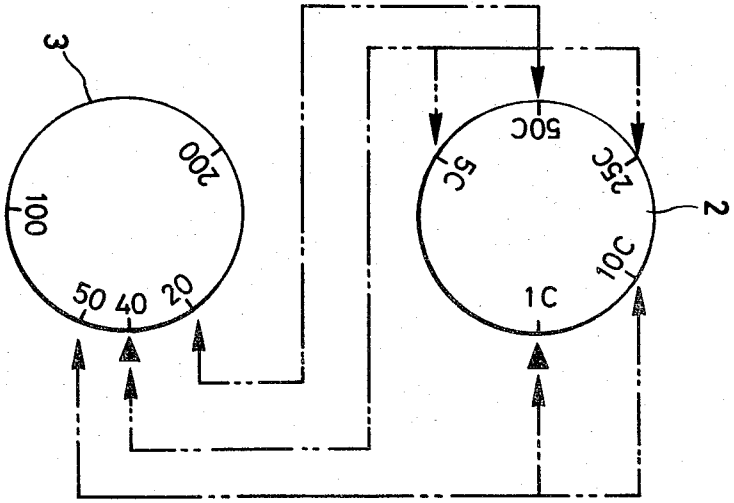
FIG. 4 is also a schematic view illustrating the relationship between coin kind and number setting dials.

The afore-mentioned coin kind setting dial 2 is formed on its surface with indications of the kinds of coins such as 1C (one cent), 10C, 25C, 50C and 5C. On the other hand, the coin number setting dial 3 is formed on its surface with indications of the number of the coins to be packed such as 100, 50, 40, 20 and 200. These indications are better seen from FIG. 4, in which such relationships are illustrated in arrows of double dotted lines between the kind and number of coins as the coins of 1C and 10C are packaged in 50, as the coins of 50C are packaged in 20, and as the coins of 25C and 5C are packed in 40.

Figure 3A:
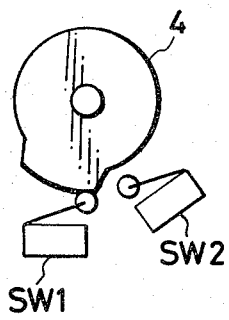
FIGS. 3A to 3C are schematic views showing the operating conditions of setting switches.
Figure 3B:
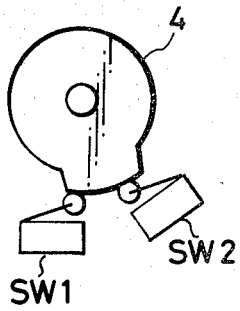
Figure 3C:
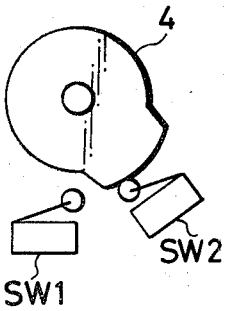

FIGS. 3A to 3C are schematic views showing the operating conditions of the setting switches SW1 and SW2. As seen from FIG. 3A, only the setting switch SW1 is operated to set 20 coins of 50C for the packaging purpose. Turning to FIG. 3B, the two setting switches SW1 and SW2 are operated to set 40 coins of 25C and 5C for the same purpose. Turning to FIG. 3C, only the setting switch SW2 is operated to set 50 coins of 10C and 1C.

Figure 5:
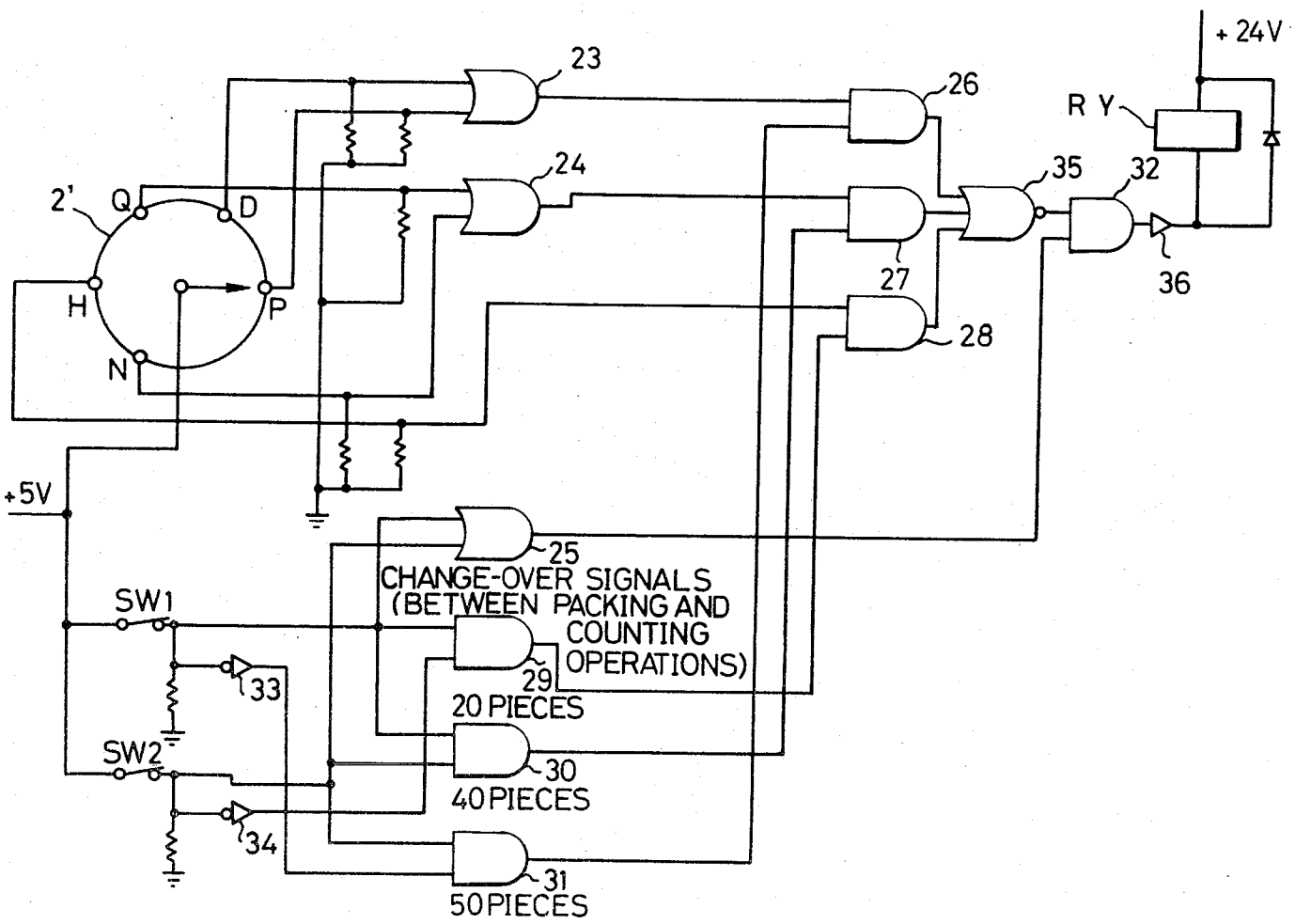
FIG. 5 is a diagrammatical presentation showing a circuit to be used in the device according to the present invention.

FIG. 5 is a diagrammatical presentation showing the circuit between the kind and number of the coins, which is to be used with the mechanical counting mechanism shown in FIG. 2. In the coin kind setting switch 2', reference letters P, N, D, Q and H designate the switching positions of the coins of 1C (Penny), 5C (Nickel), 10C (Dime), 25C (Quarter), and 50C (Half Dollar), respectively. In the circuit, moreover, reference numerals 23 to 25 indicate OR gates, numerals 26 to 32 indicate AND gates, numerals 33 and 34 indicate inverters, numeral 35 indicates a NOR gate, numeral 36 indicates a buffer driver, and reference letter RY indicates an incoincidence relay.

In case the switching positions are set at D or P by the coin kind setting switch 2' which is made responsive to the setting operations of the coin kind setting dial 2, high signals are fed to the AND gate 26 via the OR gate 23. In case the switching positions are set at Q or N, high signals are fed to the AND gate 27 via the OR gate 24. In case, moreover, the switching positions are set at H, high signals are fed directly to the AND gate 28.

On the other hand, when the coin number setting dial 3 is set at the position of 20 pieces, high signals are fed from the AND gate 29 to the AND gate 28. When the dial 3 is set at the position of 40 pieces, high signals are fed from the AND gate 30 to the AND gate 27. When, moreover, the dial 3 is set at the position of 50 pieces, high signals are fed from the AND gate 31 to the AND gate 26.

In case the coin number setting dial 3 is set at the number of the coins of the kind which is set by the coin kind setting dial 2, one of the output of the AND gates 26 to 28 becomes high while the output of the NOR gate 35 becomes low, thus effecting the counting and packing operations in a normal manner. In case, on the contrary, the dial 3 is not set at the number of the coins of the kind set by the coin kind setting dial 2, all of the outputs of the AND gates 26 to 28 become low while the output of the NOR gate 35 becomes high. During the packaging operations, either of the inputs of the OR gate 25 becomes high so that the output thereof also becomes high, thus producing the signals indicative of the packaging operations. During the counting operations, both of the inputs of the OR gate 25 become low so that the output thereof also becomes low, thus producing the signals indicative of the counting operations.

If, during the packaging operations, the coin number setting dial 3 is not set at the number of the coins of the kind which is set by the coin kind setting dial 2, both of the inputs of the AND gate 32 become high, and accordingly the output of the same also becomes high so that high signals are fed to the buffer driver 36. As a result, the relay RY is operated by the buffer driver 36 so that the warning signal circuit is operated by the relay RY thereby to leave the mechanism inoperative.

Figure 6:
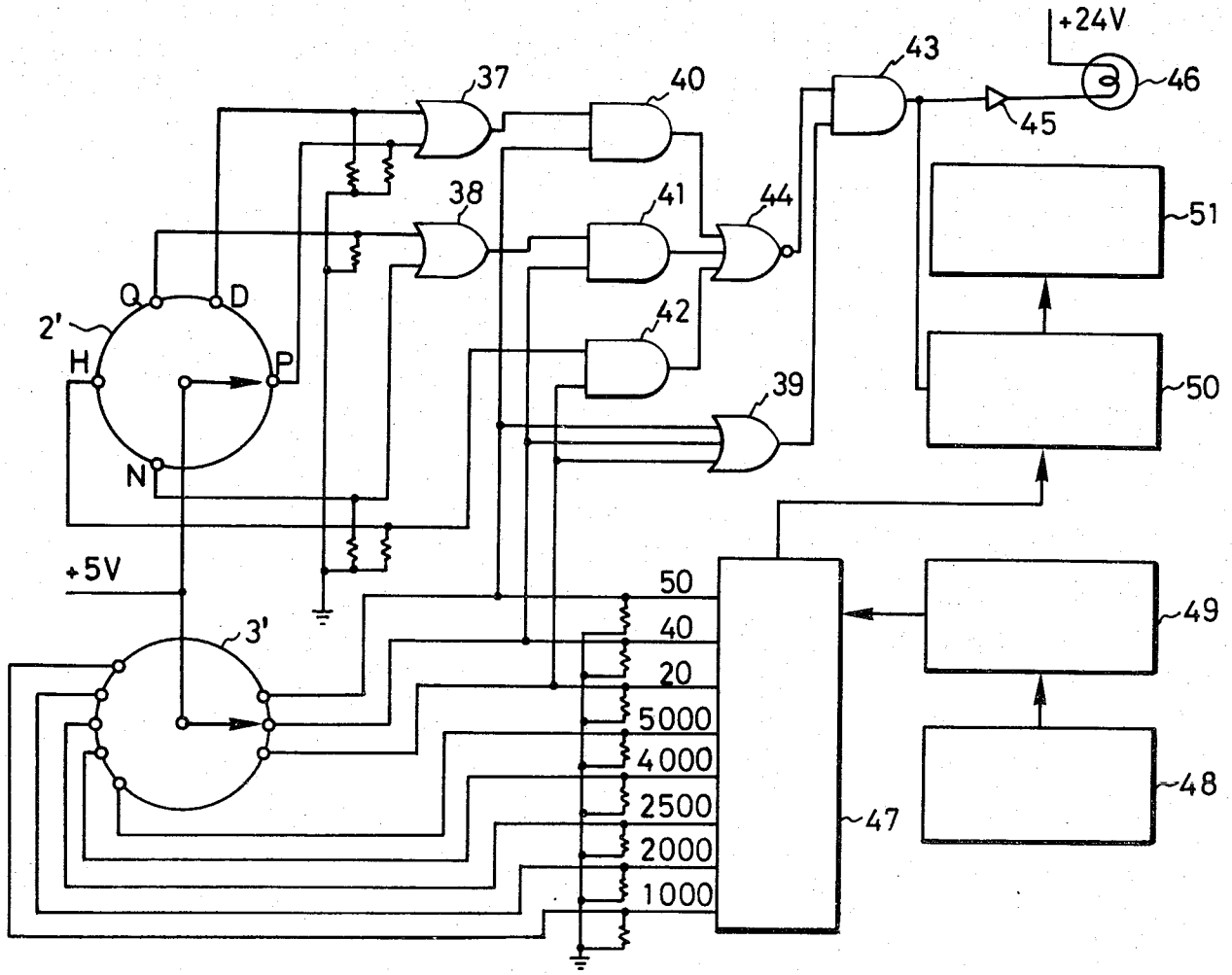
FIG. 6 is similar to FIG. 5 but shows another embodiment of the circuit.

Another embodiment of the present invention will now be described with reference to FIG. 6, in which a selecting circuit of the kind and number of the coins to be used with a counting mechanism of electric type is shown. The coin kind setting switch 2' is made to have a similar construction to that of the foregoing embodiment, but a coin number setting switch 3' is constructed to have switching positions of 20, 40, 50, 1000, 2000, 2500, 4000 and 5000 pieces. In the circuit, moreover, reference numerals 37 to 39 indicate OR gates, numerals 40 to 43 indicate AND gates, numeral 44 indicates a NOR gate, numeral 45 indicates a buffer drive gate, numeral 46 indicates a warning lamp, numeral 47 indicates a coin number selecting gate, numeral 48 indicates a coin detecting sensor, numeral 49 indicates a coin number counting circuit, numeral 50 indicates a count stopping circuit, and numeral 51 indicates a packaging circuit.

In case the switching positions are set at D or P by the coin kind setting switch 2' which is made responsive to the setting operations of the coin kind setting dial 2, high signals are fed to the AND gate 40 via the OR gate 37. In case the switching positions are set at Q or N, high signals are fed to the AND gate 41 via the OR gate 38. In case, moreover, the switching positions are set at H, high signals are fed directly to the AND gate 42.

On the other hand, when the coin number setting dial 3' is set at the position of 50 pieces, high signals are fed both to the gate of 50 pieces of the coin number selecting gate 47 and to the AND gate 40. When the dial 3' is set at the position of 40 pieces, high signals are fed both to the gate of 40 pieces of the coin number selecting gate 47 and to the AND gate 41. When, moreover, the dial 3' is set at the position of 20 pieces, high signals are fed both to the gate of 20 pieces of the coin number selecting gate 47 and to the AND gate 42.

In case the coin number setting dial 3 is set at the number of the coins of the kind which is set by the coin kind setting dial 2, one of the outputs of the AND gates 40 to 42 becomes high while the output of the NOR gate 44 becomes low, thus effecting the counting and packaging operations is a normal manner. In case, on the contrary, the dial 3 is not set at the number of coins of the kind set by the coin kind setting dial 2, all of the outputs of the AND gates 40 to 42 become low while the output of the NOR gate 44 becomes high. During the packaging operations, any of the three inputs of the OR gate 39 becomes high so that the output thereof also becomes high, thus producing the signals indicative of the packing operations. During the counting operations, all of the three inputs of the OR gate 39 become low so that the output thereof also becomes low, thus producing signals indicative of the counting operations.

If, during the packing operations, the coin number setting dial 3 is not set at the number of the coins of the kind which is set by the coin kind setting dial 2, both of the inputs of the AND gate 43 become high, and accordingly the output of the same also becomes high so that high signals are fed to the buffer drive gate 46 and the count stopping circuit 50. As a result, the warning lamp 46 is turned on by the actions of the signals which are fed to the buffer drive gate 45. Moreover, the packaging and counting operations can be prevented from starting, even if a start button is depressed, by the actions of the signals which are fed to the count stopping circuit 50.

Figure 7:
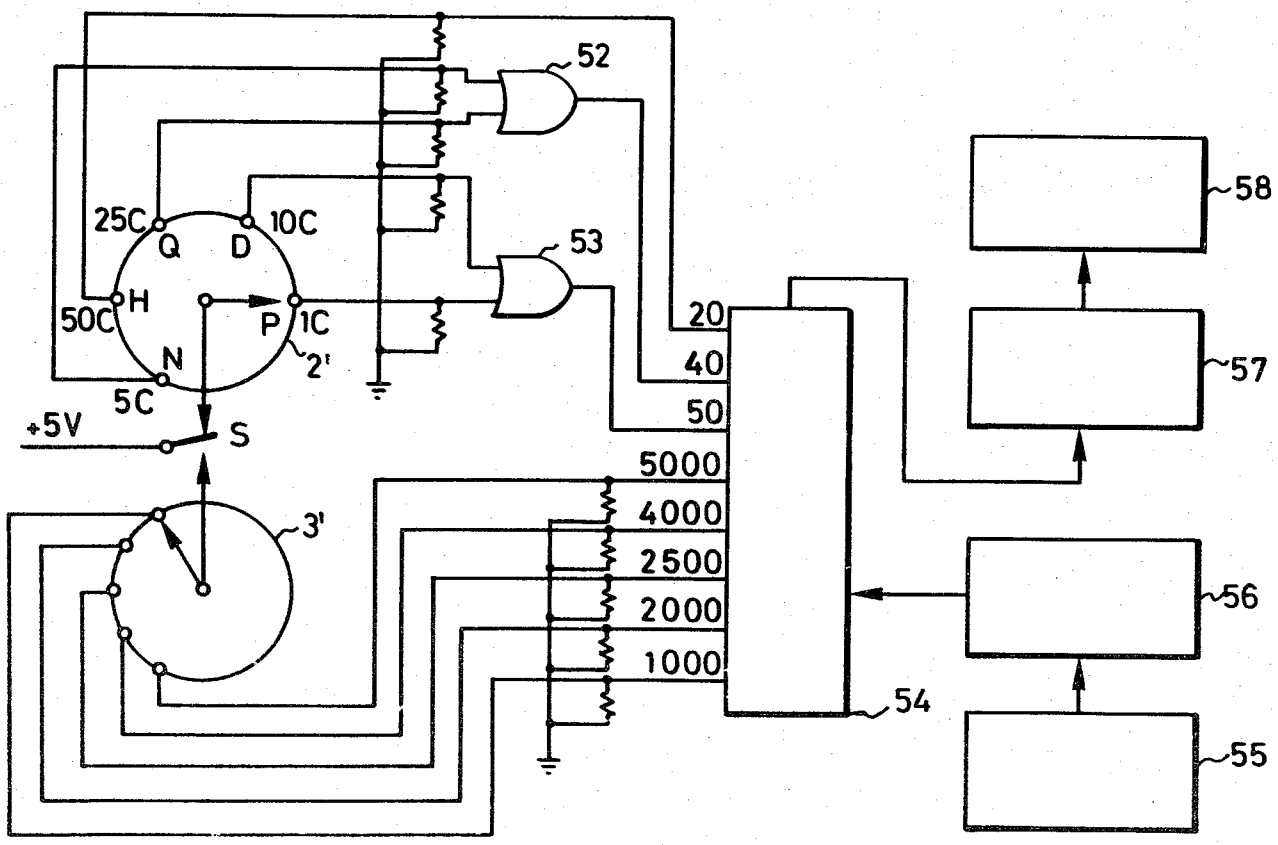
FIG. 7 is similar to FIGS. 5 and 6 but shows still another embodiment of the circuit.

Description will proceed further to a third embodiment of the present invention with reference to FIG. 7. In this embodiment, a change-over switch S for selecting the packing or counting operation is used. FIG. 7 is a diagrammatical presentation showing the circuit, by which the number of coins to be packaged can be automatically selected merely by selecting the kind of coins with the use of the coin kind setting dial 2 if the change-over switch S is set at its packaging position. In the circuit, moreover, reference numerals 52 and 53 indicate OR gates, numeral 54 indicates a coin number selecting gate, numeral 55 indicates a coin selecting sensor, numeral 56 indicates a 1C counting circuit, numeral 57 indicates a count stopping circuit, and numeral 58 indicates a packing circuit. The circuit thus constructed is of the type, in which the coin kind setting dial 2 can be set at any position during the packaging operations. During the packaging operations, therefore, the change-over switch S is shifted to its packaging position, and a voltage of +5 volts is fed via the contacts of the switch S to the coin kind setting switch 2' which is made responsive to the setting operations of the coin kind setting dial 2.

When the coin kind setting dial 2 is set at the position P or D, the gate for effecting the packaging operations in 50 pieces is opened by the actions of the OR gate 53. When the dial 2 is set at the position N or Q, the gate for effecting the packaging operations in 40 pieces is opened by the actions of the OR gate 52. When, moreover, the dial 2 is set at the position H, the gate for effecting the packing operations in 20 pieces is opened. Thus, when the kind of coins is set by the coin kind setting dial 2 and the start button is depressed, the counting operations are started such that the passage of the coins is detected by the coin detecting sensor 55 thereby to effect the counting operations by means of the 1C counting circuit 56. If the logic sum is taken between the coin number selecting signals and the signals of the 1C counting circuit 56, the count stopping signals are fed to the count stopping circuit 57 so that the packing operations can be started.

Figure 8:
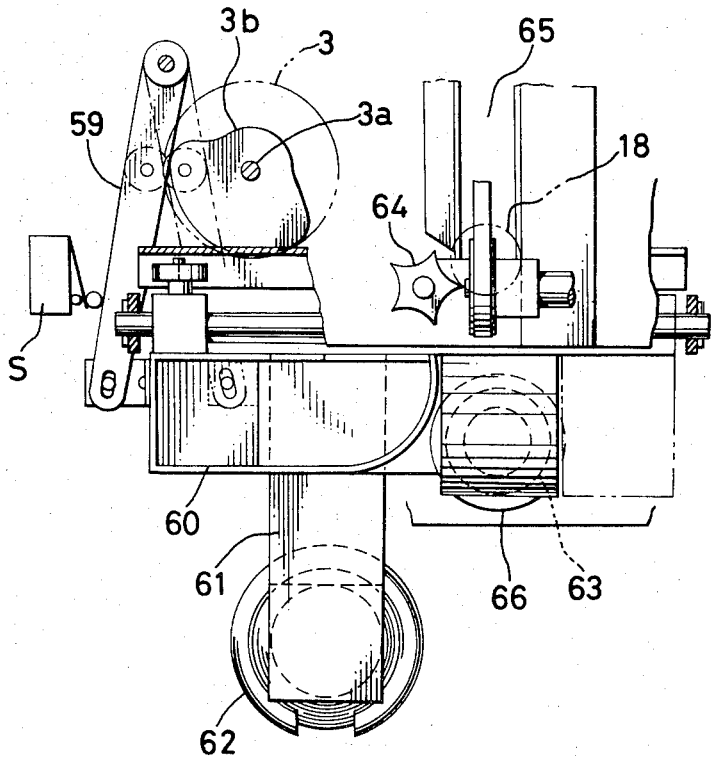
FIG. 8 is a top plan view showing major portions of the coin packaging machine to be used with the third embodiment of the circuit shown in FIG. 7.
Figure 9:
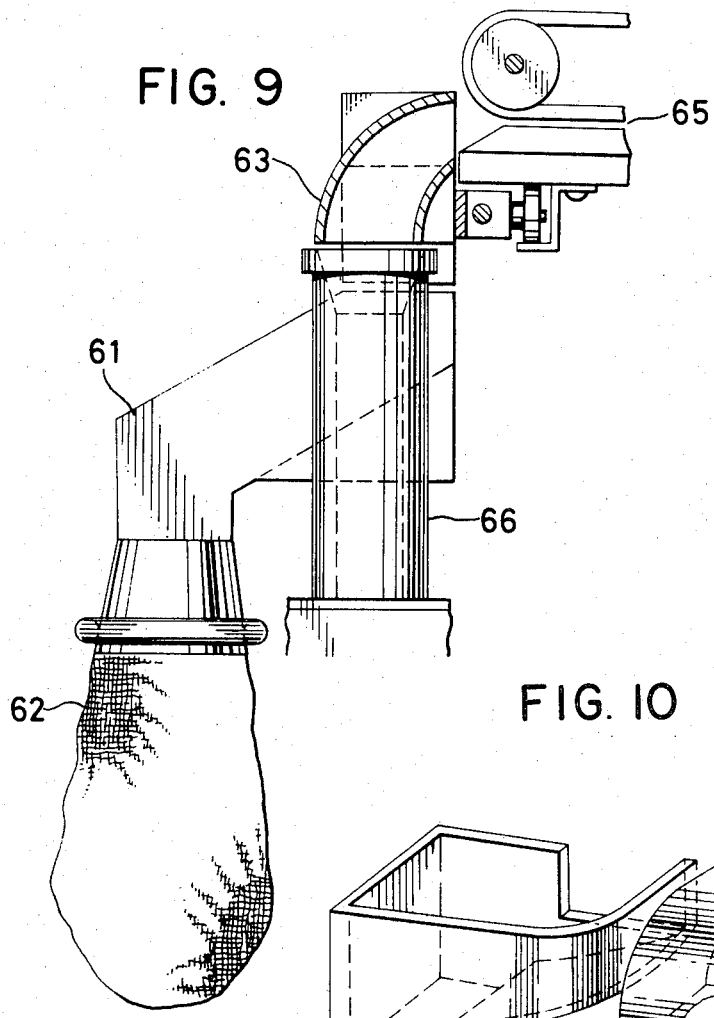
FIG. 9 is a side elevation showing the major portions of the coin packaging machine shown in FIG. 8.

FIGS. 8 and 9 are the top plan view and side elevation of major portions of the coin packing machine to be used with the third embodiment of circuit shown in FIG. 7. In FIGS. 8 and 9, reference numeral 3*a* indicates a dial shaft, numeral 3*b* indicates a change-over cam, numeral 59 indicates an operating arm, numeral 60 indicates a counting chute of movable type, numeral 61 indicates a counting chute, numeral 62 indicates a bag, numeral 63 indicates a packaging chute, numeral 64 indicates a counting star-wheel, numeral 65 indicates a selecting path, and numeral 66 indicates a collecting cylinder.

Figure 10:
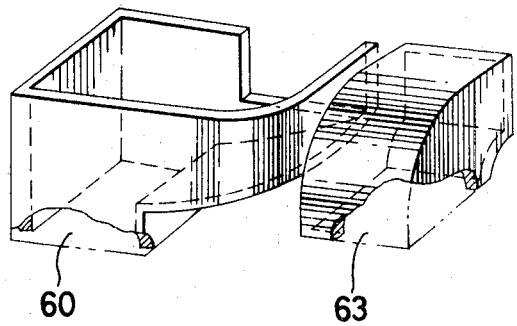
FIG. 10 is a partially cut-away perspective view showing the construction arrangement of counting and packaging chutes.

In response to the setting operations of the coin number setting dial 3, the change-over cam 3*b* operates the operating arm 59 so that the counting chute 60 can be moved. With additional reference to FIG. 10, more specifically, the counting chute 60 is located, during the packing operations, in its left position (shown in solid lines in FIG. 8) so that the packaging chute 63 has communication with the collecting cylinder 66. During the counting operations, on the other hand, the counting chute 60 is located in its right position (shown in imaginary lines in FIG. 8) so that it has communication with the counting chute 61 leading to the bag 62. In these ways, the change-over between the packing and counting operations can be accomplished so that the coins 18 can be fed to either counting chute 61 or the packaging chute 63. In response to these operations, the operations of the change-over switch S shown in FIG. 7 can be effected through the operating arm 59.

As has been described hereinbefore, the device according to the present invention can keep the coin packaging machine inoperative in case the number of coins is different from that which is set for the kind of the coins to be packaged. In case, moreover, the kind of coins is set, the coins of the number for the kind can be automatically set for the packaging purpose. Thus, the operability of the coin packaging machine can be so improved by the device of the invention that the afore-mentioned malfanctions or troubles can be reliably prevented. As a result, the mental loads upon the operator can be so reduced as to bring the device of the invention into suitable practice.

What is claimed is:

1. A coin packaging machine having a packaging mode, wherein a specific kind of coins is selected, a relatively small packaging number of coins being determined in accordance with the specific kind of coins and the determined number of coins being packaged, said machine having a counting mode, wherein a relatively large number of coins is counted, comprising:

coin kind setting dial means for setting a kind of coins in the packaging mode, coin kind setting switches actuated by said coin kind setting dial means, first means operatively connected to said coin kind setting switches for determining the packaging number of the coins of the set kind, coin number setting dial means for setting the counting number of coins in the counting mode, coin number setting switches actuated by said coin number setting dial means, second means operatively connected to said coin number setting switches for determining the counting number of coins, a cam provided on said coin number setting dial, switch means actuated by said cam for selectively supplying electric power to either said coin kind setting switches or said coin number setting switches so as to select either the packaging mode or the counting mode, packaging chute means driven by said cam for receiving coins to be packaged, and counting chute means driven by said cam for receiving coins to be counted.

* * * * *